US008552627B2

(12) United States Patent
Frey et al.

(10) Patent No.: US 8,552,627 B2
(45) Date of Patent: Oct. 8, 2013

(54) RETAINING FRAME HAVING AT LEAST ONE OPTICAL ELEMENT

(75) Inventors: Peter Frey, Heidenheim (DE); Thomas Reiners, Bachhagel (DE); Ralf Vollmer, Ulm (DE)

(73) Assignee: OSRAM Gesellschaft mit beschrankter Haftung, Munich (DE)

( * ) Notice: Subject to any disclaimer, the term of this patent is extended or adjusted under 35 U.S.C. 154(b) by 0 days.

(21) Appl. No.: 13/054,617

(22) PCT Filed: Jul. 13, 2009

(86) PCT No.: PCT/EP2009/058933

§ 371 (c)(1),
(2), (4) Date: Jan. 18, 2011

(87) PCT Pub. No.: WO2010/007028

PCT Pub. Date: Jan. 21, 2010

(65) Prior Publication Data

US 2011/0121708 A1 May 26, 2011

(30) Foreign Application Priority Data

Jul. 16, 2008 (DE) ..... 10 2008 033 384

(51) Int. Cl.
*H01J 5/16* (2006.01)
*F21V 5/00* (2006.01)

(52) U.S. Cl.
USPC ..... 313/110; 362/257; 362/235; 362/336; 362/340; 264/272.15

(58) Field of Classification Search
USPC ..... 313/110, 113
See application file for complete search history.

(56) References Cited

U.S. PATENT DOCUMENTS

| | | | | |
|---|---|---|---|---|
| 5,632,551 | A * | 5/1997 | Roney et al. | 362/485 |
| 5,707,133 | A * | 1/1998 | Burton | 362/460 |
| 6,267,488 | B1 * | 7/2001 | Muegge et al. | 362/509 |
| 7,423,823 | B2 * | 9/2008 | Naganuma et al. | 359/820 |
| 7,581,860 | B2 | 9/2009 | Bogner et al. | |
| 7,855,494 | B2 * | 12/2010 | Umezawa | 313/113 |
| 2004/0027696 | A1 | 2/2004 | Moret | |
| 2005/0128762 | A1 | 6/2005 | Goraguer | |
| 2008/0151547 | A1 * | 6/2008 | Grotsch et al. | 362/257 |

FOREIGN PATENT DOCUMENTS

| | | |
|---|---|---|
| CN | 1576935 | 2/2005 |
| CN | 1638940 | 7/2005 |
| CN | 101175943 | 5/2008 |
| DE | 103 14 524 | 10/2004 |
| EP | 0 100 379 | 2/1984 |
| EP | 0 892 209 | 1/1999 |
| EP | 0 961 074 | 12/1999 |
| JP | 06-162806 | 6/1994 |
| JP | 08-306209 | 11/1996 |
| JP | 2006-134707 | 5/2006 |
| JP | 2006-521667 | 9/2006 |
| WO | WO 03/031871 | 4/2003 |
| WO | WO 2006/097067 | 9/2006 |
| WO | WO 2006/098302 | 9/2006 |

* cited by examiner

*Primary Examiner* — Sikha Roy
(74) *Attorney, Agent, or Firm* — Cozen O'Connor

(57) ABSTRACT

A retaining frame (2) having at least one optical element (3) secured thereto by injection molding, with the at least one optical element (3) being embodied for beam shaping at least by means of total internal reflection and/or diffraction.

10 Claims, 3 Drawing Sheets

RETAINING FRAME HAVING AT LEAST ONE OPTICAL ELEMENT

RELATED APPLICATIONS

This is a U.S. national stage of application No. PCT/EP2009/058933, filed on Jul. 13, 2009.

This application claims the priority of German application no. 10 2008 033 384.0 filed Jul. 16, 2008, the entire content of which is hereby incorporated by reference.

FIELD OF THE INVENTION

The invention relates to a retaining frame having at least one optical element secured thereto, to a method for mounting an optical element on a retaining frame, and to an illumination device, in particular a vehicle-headlight module, having a retaining frame.

BACKGROUND OF THE INVENTION

US 2005/0128762 A1 describes an illumination device that includes a lens support and a glass lens that is designed to be placed in front of a light source, said lens (an optical element that images by means of light refraction) being assembled to the lens support which is secured to the light source, said support being made of a plastic material, said lens having a rear face designed to face toward the light source, an optical front face, and a peripheral rim which interconnects the rear face and the front face, the lens support coming into engagement with the lens at said rim, the lamp being characterized in that the support is fixed to the lens by overmolding, the material of which the support is made surrounding the rim of the lens at least in part.

SUMMARY OF THE INVENTION

It is one object of the present invention to provide an arrangement for retaining an optical element, in particular for an illumination device, in particular with a further reduction in the load on the optical element requiring to be accommodated.

Said object is achieved by means of a retaining frame, by means of a method for producing a system comprising a retaining frame and an optical element secured thereto, and by means of an illumination device, in particular a vehicle-headlight module, as claimed in the respective independent claim. Preferred embodiments may be gleaned in particular from the dependent claims.

The retaining frame is fitted with at least one optical element secured thereto by injection molding, with the at least one optical element being embodied for beam shaping at least by means of total internal reflection and/or diffraction. What is understood by an optical element having at least total internal reflection and/or diffraction is an optical element whose beam guidance is based on total internal reflection and/or diffraction but can additionally also be based on refraction.

It is particularly preferred for the at least one optical element to have a CPC-like region, a CEC-like region, and/or a CHC-like region. It is in particular possible to use a CPC-like concentrator, that being understood as a concentrator whose reflecting side walls are shaped at least partially and/or at least very substantially like a compound parabolic concentrator (CPC). It is also possible to use, for example, a compound elliptic concentrator (CEC) and/or a compound hyperbolic concentrator (CHC).

The use of a freeform concentrator is particularly preferred. Particularly when used as primary optics in a vehicle-headlight module, a concentrator can preferably serve to cast light from a light source onto secondary optics, in the process setting a light-distribution pattern, for example producing a bright/dark boundary. It can, though, alternatively or additionally also be preferred for the optical element to have a region shaped like a truncated pyramid or a truncated cone.

For mechanically well-mannered securing to the retaining frame, the optical element has preferably at least two projections, ones that are in particular laterally arranged. What is preferred is to provide precisely two projections at opposite locations. To reduce the transmission of mechanical and/or thermal loads it is particularly preferred for the projections to be arranged on only a small part of a circumference of the optical element.

It is particularly preferred for the projections to be held on the retaining frame by means of a marginal, in particular narrow, arch.

What is particularly preferred is a retaining frame that consists of a plastic material, in particular a thermoplastic material, especially PPS ("polyphenylene sulfide", referred to also as "poly(thio-p-phenylene"), particularly linear PPS. The good mechanical properties of PPS are retained even at temperatures far in excess of 200° C. so that continuous use up to 240° C. is possible depending on the load. Even loads at temperatures of up to 270° C. are withstood for brief periods. What is also outstanding is the chemical resistance to virtually all solvents, many acids and alkalis, and, conditionally, to atmospheric oxygen even at high temperatures. Besides low water absorption, PPS furthermore has good dimensional stability and inherent flame-retardant properties. It has excellent electrically insulating properties, is highly impervious to most liquids and gases, has only a slight tendency to creep even at relatively high temperatures, and owing to its good flow characteristics is also suitable for long, narrow moldings and complex tool geometries. Linear PPS can in contrast to cross-linked PPS be molded into components by a wide range of processing methods.

What is preferred for reducing scattered light particularly effectively is a retaining frame in the case of which an inner side of the wall that is provided for being directed toward the optical element has a light-absorbing surface structure.

The wall can for that purposes be, for example, roughened and/or coated with a light-absorbing layer.

A retaining frame having a closed circumferential wall for surrounding the optical element laterally is furthermore preferred for reducing scattered light effectively and all-round.

The method for producing a system comprising a retaining frame and an optical element secured thereto has at least the step of injection-molding the retaining frame, with the optical element being molded to the retaining frame only at a plurality of securing projections, in particular by means of a marginal arch.

The retaining element can then in a further step be joined to the light source directly or via further means such as, for instance, circuit supports, heat sinks, or substrate plates.

The illumination device is fitted with a retaining frame of such kind and has at least one semiconductor light source, in particular a light-emitting diode, downstream of which the optical element is connected, in particular as primary optics.

The optical element can consist of glass or transparent plastic, preferably silicon.

BRIEF DESCRIPTION OF THE DRAWINGS

The invention is described schematically in more detail in the following figures with the aid of an exemplary embodiment. Elements that are physically or functionally identical can for the sake of clarity therein be provided with the same reference numerals.

DETAILED DESCRIPTION OF THE DRAWINGS

Figure 1:
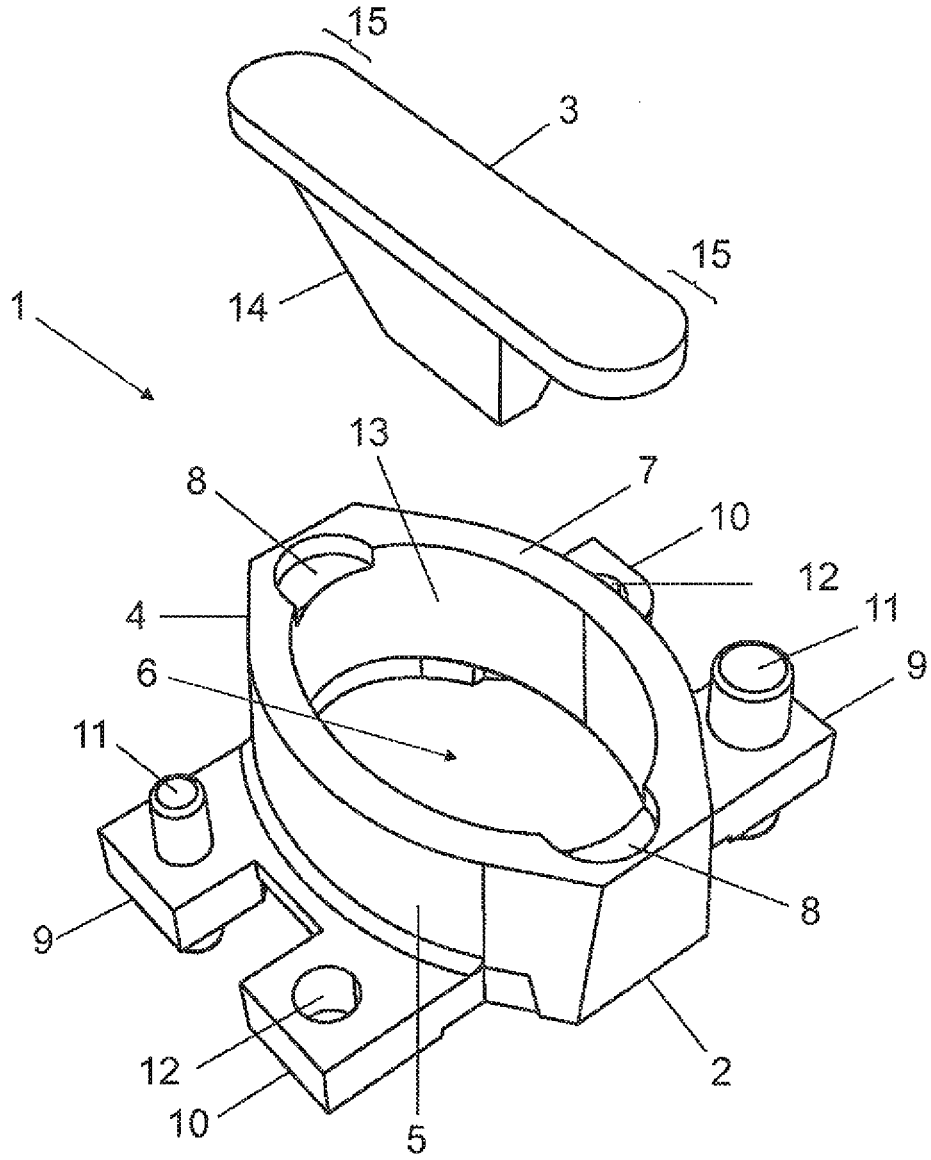
FIG. 1 is an exploded representation of a frame viewed obliquely from above for an optical element, with the optical element to be held therein separated therefrom.

FIG. 1 is an exploded representation of an optical system 1 having a retaining frame 2 and an optical element 3 requiring to be secured to the frame. Optical system 1 is typically connected downstream of one or more light sources and serves as a beam guide for at least a part of the light emitted by the light source or sources. Optical system 1 can be used as, for example, part of an automobile luminaire, for example a headlight.

Retaining frame 2 has a hollow basic body 4 that is open on the top and bottom sides and formed by means of a closed circumferential, thick wall 5 having a substantially oval continuous contour. Inner cavity 6 formed thereby of basic body 4 serves to accommodate optical element 3. Basic body 4 has for that purpose on its top edge 7 two accommodating regions in the form of opposite depressions 8. In a lower region of basic body 4 are four laterally projecting lugs 9, 10 for securing retaining frame 2 to a luminaire that is not shown here. For guiding retaining frame 2, two obliquely opposite lugs 9 have perpendicular guide pins 11 whose lower part serves to position retaining frame 2 and whose upper part serves to position secondary optics. The other two lugs 10 have through-holes 12 for guiding securing screws through.

Retaining frame 2 is produced from linear PPS. The PPS is blackened to minimize the reflecting of light on retaining frame 2. Undesired scattered light that strikes retaining frame 2 can be suppressed thereby. Inner side 13 of basic body 4 or, as the case may be, its wall 5 has been roughened for further suppressing the reflecting of light on retaining frame 2. A lateral exiting of scattered light from retaining frame 2 is also suppressed by the closed circumferential shape of wall 5.

Optical element 3 is embodied as being total internal reflection (TIR) optics having a glass basic body 14 with the asymmetric shape of a truncated pyramid. Thus fashioned primary optics will make an efficient reduction in light divergence possible, as a result of which in particular headlights can be achieved having sufficient brightness and well-defined emission characteristics.

Optical element 3 has a corresponding securing region having two lateral lug-shaped projections 15 for securing to retaining frame 2. Projections 15 substantially fulfill the securing function and have only a negligible impact on the optical property of optical element 3. An advantage of securing only on projections 15 is that a bright/dark boundary can then be well defined. Optical element 3 is hence secured to retaining frame 2 only by projections 15 while the remaining surface is free. Because projections 15 occupy a small section of optical element 3 in the circumferential direction (specifically being arranged only on the narrow sides of the top edge), their mechanical loading, which could result from a mounting operation, will affect the remaining volume of optical element 3 only slightly because distortions in the material can here be at least partially reduced by the free surface. That "good nature toward loading" is all the more pronounced the fewer the number of projections 15 used and the smaller the relative securing region.

It must be borne in mind that optical system 1 is produced by injection-molding retaining frame 2, meaning that retaining frame 2 and optical element 3 are not separate in accordance with their intended used.

Figure 2:
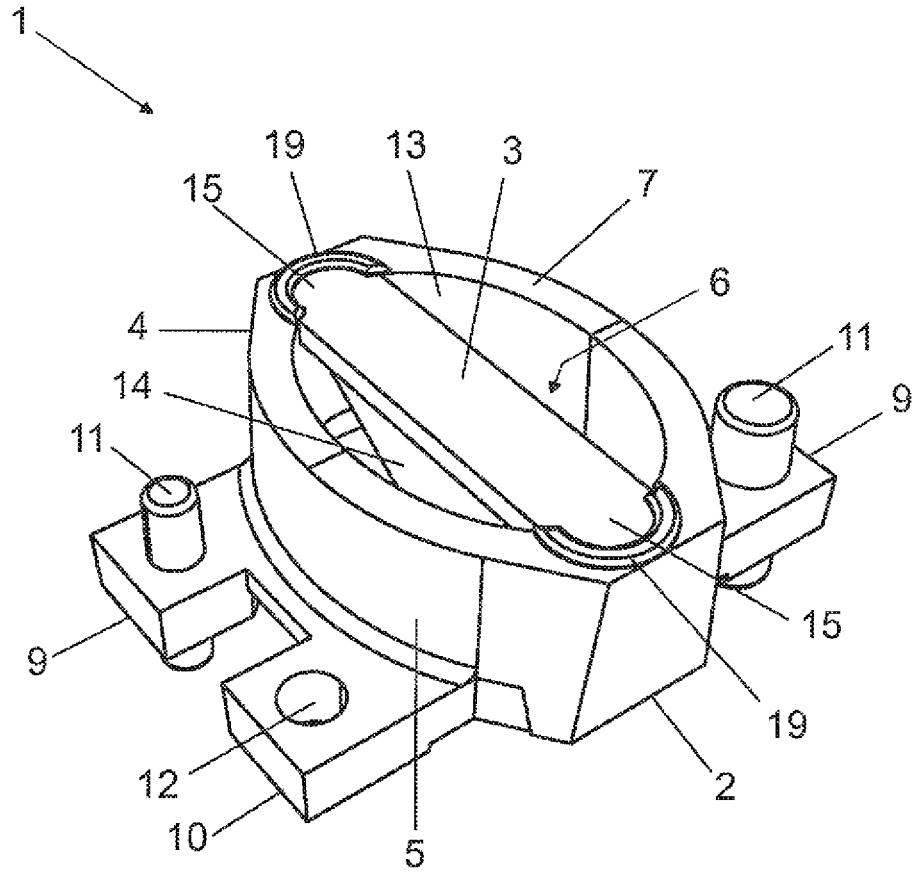
FIG. 2 is an oblique view from above of the system shown in FIG. 1 having the optical element secured to the frame.

FIG. 2 shows optical system 1 with retaining frame 2 and optical element 3 joined together. That is done by injection-molding retaining frame 2 to optical element 3. Because TIR element 3 is substantially flush on the top side with top edge 7 of retaining frame 2, a narrow, marginal arch 19 starts directly above projection 15 of optical TIR element 3 and holds optical element 3 on retaining frame 2.

Compared with totally circumferential securing, for example by means of a circumferential securing edge, what results from projections 15 present only in sections on the edge side is firstly the advantage that the thermal load on optical element 3 will be much less and, secondly, that the connection will be easier to produce by injection-molding. That is supported by the only narrow arch 19. Even an optical element made of silicon may consequently be used.

The surface of optical element 3 outside projections 15 is not in contact with retaining element 2. A view along inner cavity 6 from above or below will show a free space remaining that extends, except for projections 15, circumferentially between optical element 3 and retaining frame 2. Optical element 2 therefore does not close inner cavity 6. Thanks to that "loose" arrangement it will be possible to insert variously shaped optical elements (concentrators, diffraction gratings etc.) into the same retaining frame 2.

Figure 3:
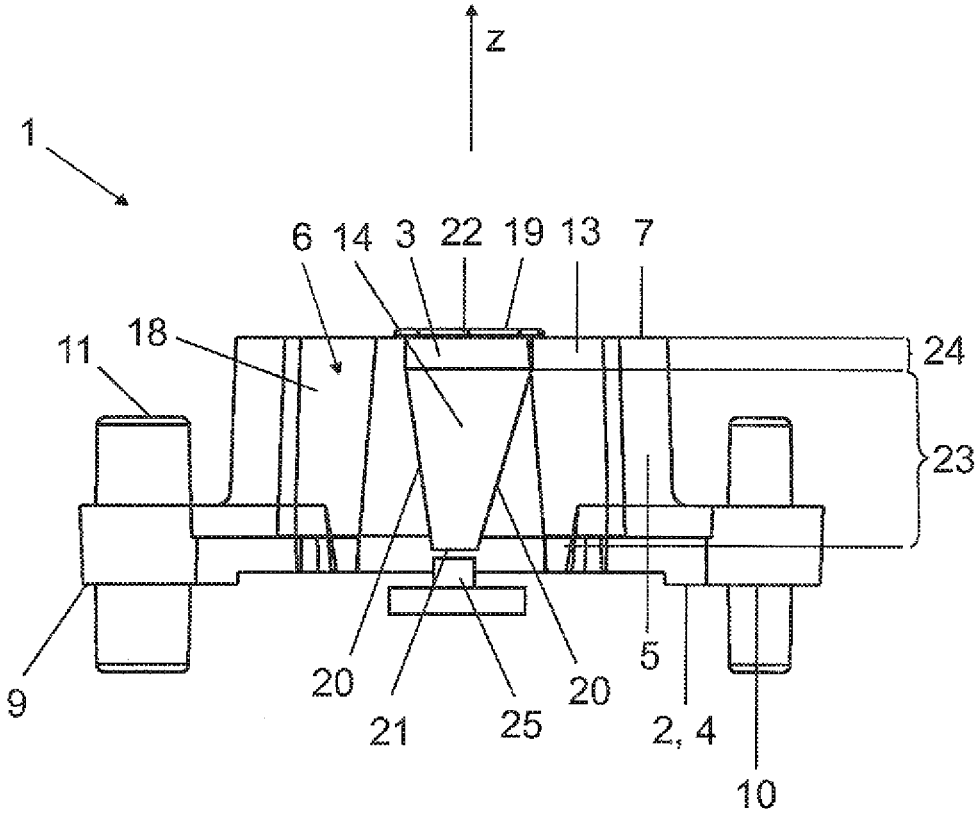
FIG. 3 is a sectional representation viewed from the side of an illumination device having a system as shown in FIG. 2.

FIG. 3 shows a cross-section of the illumination device having a system as shown in FIG. 2. That view shows that optical element 3 (TIR concentrator) is not embodied as being symmetrical. Thus the two side walls 20 are differently oblique, although direct connecting lines between a lower light-entry surface 21 and an upper light-exit surface 22 run along them in substantially rectilinear fashion. Furthermore, adjoining above truncated-pyramid-shaped region 23 of optical element 3 is a non-widening region of extent 24 on which the lateral lugs are also arranged. Arches 19 hold optical element 3 firmly against the edge of upper light-exit surface 22. Optical element 3 is completely surrounded laterally by retaining frame 17 along its longitudinal extent (parallel to the z axis). It can be seen from the cross-sectional representation shown here of the narrower side of optical element 3 that optical element 2 fills less than a third of inner cavity 6 but does so over virtually its entire length (along the z direction).

Light during operation is fed from a light-emitting diode 25 into lower light-entry surface 21 of optical element 3, as is merely outlined here. Light-emitting diode 25, here constructed from a plurality of white-emitting LED chips fitted on a common submount, is arranged so near the lower light-entry surface 21 that light emitted by it mostly enters lower light-entry surface 21 and only a small portion is radiated onto inner side 13 of wall 5 of retaining frame 2. No light is radiated by LED 25 directly through the free space between optical element 3 and wall 5. Light incident upon inner side 13 is absorbed by the light-absorbing property thereof. Consequently, light is emitted to the outside (in this case upward) only by optical element 3. To be more exact, light entering lower light-entry surface 21 runs either directly through optical element 3 as far as upper light-exit surface 22, from where it is re-emitted, or light beams striking side walls 20 of optical element 3 are reflected back again into optical element 3 by means of total internal reflection (TIR). The result is a desired illumination pattern having only slight radiation losses.

The present invention is of course not limited to the exemplary embodiments shown.

Thus instead of PPS it is also possible to use another plastic, preferably thermoplastic, material. It will preferably be opaque.

The type of optical element is not limited. Instead of the TIR concentrator designed having a substantially truncated-pyramid shape, it is also possible to use, for example, a basic shape substantially that of a truncated cone.

Instead of a TIR concentrator it is, though, also possible to use, for example, a freeform, CPC-like, CEC-like, or CHC-like concentrator.

It is also possible to use a combined concentrator/diffraction optics, for example by attaching diffraction structures to a concentrator.

It is also possible to make general use of deflecting prisms.

Alternatively, in particular refracting optical elements such as a Fresnel zone plate or a diffraction grating can also be held in the retaining frame.

The optical element can have a microstructured surface, for example what is termed a pillow structure, for beam shaping.

The number of securing regions, in particular securing projections, of the optical element is not limited. Thus there can also be more than two securing regions or just one, sole accommodating region in the form of, for instance, a partially or completely circumferential edge.

The semiconductor light source preferably includes at least one light-emitting diode. The light source can be, for example, an LED module having a light-emitting-diode chip or a plurality of light-emitting-diode chips, or (an) individual housed LED(s) ('LED lamp'.) preferably emitting white light, for example a conversion LED. If there are a plurality of light-emitting diodes they can, for example, shine with the same color (one or more than one color) and/or with different colors. Thus an LED module may have a plurality of individual LED chips ('LED cluster') that together produce a white mixed light, for example in 'cold white' or 'warm white'. To produce a white mixed light the LED cluster preferably includes light-emitting diodes that shine in the primary colors of red (R), green (G), and blue (B). In that case, individual colors or a plurality of colors can also be produced simultaneously by a plurality of LEDs; thus ROB, RRGB, RGGB, ROBB, RGGBB etc. combinations are possible. The color combination is not, though, limited to R, G, and B but can also include, for example, white-emitting LED chips. To produce a warm white hue it is also possible for there to be, for example, one or more amber-colored LEDs ['amber' (A)]. An LED module can also have a plurality of white individual chips, as a result of which simple scalability of the light flux can be achieved. The individual chips and/or the modules can be fitted with suitable optics for beam guidance, for example Fresnel lenses, collimators, and so forth. A plurality of identical or different LED modules can be arranged at one contact, for example a plurality of identical LED modules on the same substrate. Instead of or in addition to inorganic light-emitting diodes based on, for example, InGaN or AlInGaP, general use can also be made of organic LEDs (OLEDs). Diode lasers, for example, can also be used.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

The invention claimed is:

1. A retaining frame having at least one optical element secured thereto by injection molding, with the at least one optical element being configured to beam shaping by at least one of total internal reflection and diffraction;

wherein the optical element includes at least two laterally arranged projections for securing the optical element to the retaining frame, and wherein said at least two laterally arranged projections are held on the retaining frame by a marginal arch, the optical element being molded to the retaining frame only at said laterally arranged projections by said marginal arch while a remaining surface of the optical element is not connected to the retaining frame.

2. The retaining frame as claimed in claim 1, wherein the optical element includes a freeform concentrator-like region, a CPC-like region, a CEC-like region, and/or a CHC-like region.

3. The retaining frame as claimed in claim 1, wherein the retaining frame consists of a thermoplastic material.

4. The retaining frame as claimed in claim 3, wherein the thermoplastic material comprises polyphenylene sulfide (PPS).

5. An illumination device having the retaining frame as claimed in claim 1, comprising at least one semiconductor light source, downstream of which the optical element is connected.

6. An illumination device having the retaining frame as claimed in claim 1, comprising at least one light-emitting diode downstream of which the optical element is connected.

7. The illumination device of claim 6, wherein the illumination device is a vehicle-headlight module.

8. An illumination device having the retaining frame as claimed in claim 1, comprising at least one semiconductor light source downstream of which the optical element is connected as primary optics.

9. The illumination device of claim 8, wherein the illumination device is a vehicle-headlight module.

10. A method for producing a system comprising a retaining frame and an optical element secured thereto, the method comprising:

injection-molding the retaining frame; and molding the optical element to the retaining frame while performing the injection molding of the frame only at at least two laterally arranged securing projections;

wherein the optical element is molded to the retaining frame only at said at least two laterally arranged securing projections by a marginal arch while a remaining surface of the optical element is not connected to the retaining frame.

* * * * *